US007243430B1

(12) United States Patent
Lerch

(10) Patent No.: US 7,243,430 B1
(45) Date of Patent: Jul. 17, 2007

(54) FOLDING KNIFE WITH OPENING AND CLOSING ASSISTANCE

(76) Inventor: Matthew J. Lerch, N88 W23462 N. Lisbon Rd., Sussex, WI (US) 53089

( * ) Notice: Subject to any disclaimer, the term of this patent is extended or adjusted under 35 U.S.C. 154(b) by 24 days.

(21) Appl. No.: 11/210,601

(22) Filed: Aug. 24, 2005

Related U.S. Application Data

(60) Provisional application No. 60/673,700, filed on Apr. 21, 2005.

(51) Int. Cl.
*B26B 1/04* (2006.01)

(52) U.S. Cl. ..... 30/160; 30/159

(58) Field of Classification Search ..... 30/155, 30/158, 159, 160, 161
See application file for complete search history.

(56) References Cited

U.S. PATENT DOCUMENTS 2,530,236 A * 11/1950 Erickson ..... 30/159
4,451,982 A * 6/1984 Collins ..... 30/161
5,815,927 A * 10/1998 Collins ..... 30/161
6,338,431 B1 * 1/2002 Onion ..... 30/161
6,363,615 B1 * 4/2002 Moser ..... 30/161
6,397,476 B1 6/2002 Onion ..... 30/160
6,397,477 B1 * 6/2002 Collins ..... 30/161
6,684,510 B1 * 2/2004 Collins ..... 30/161
6,810,588 B1 * 11/2004 Cheng ..... 30/153
7,107,686 B2 * 9/2006 Linn et al. ..... 30/159

* cited by examiner

*Primary Examiner*—Hwei-Siu Payer
(74) *Attorney, Agent, or Firm*—Donald J. Ersler

(57) ABSTRACT

A folding knife with opening and closing assistance preferably includes a blade, a first frame, a second frame, a coil spring, an open lock pin and a closed lock pin. One end of the blade is pivotally retained between one end of the first and second frames. The open lock pin is preferably retained in the second frame. An open lock notch is formed in a first end of the blade such that the blade may be locked in an open position with the open lock pin. The closed lock pin is radially spring loaded between the first and second frames. A closed lock notch is formed in the first end of the blade to receive the closed lock pin. The blade is locked in a closed position, when the closed lock pin is retained in the closed lock notch.

18 Claims, 8 Drawing Sheets

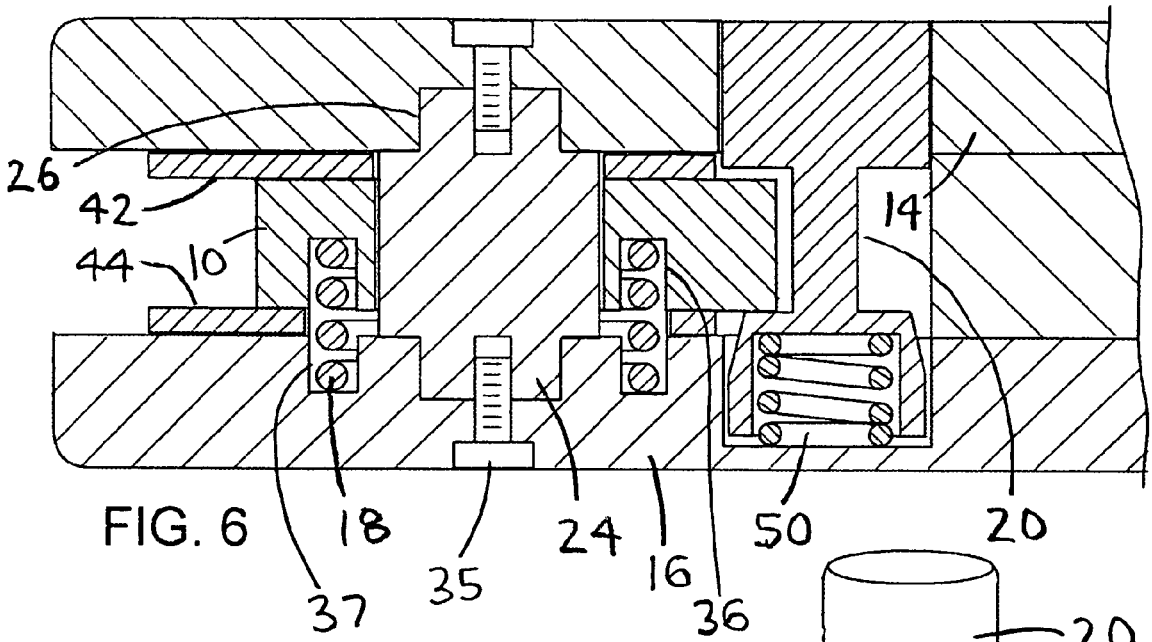
FIG. 6
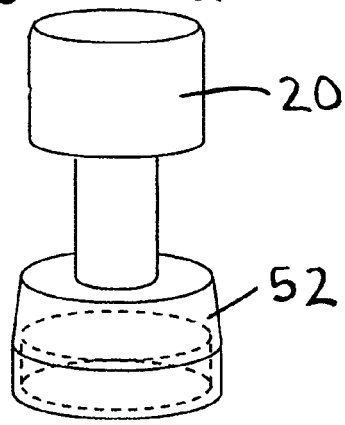
FIG. 7
FIG. 8
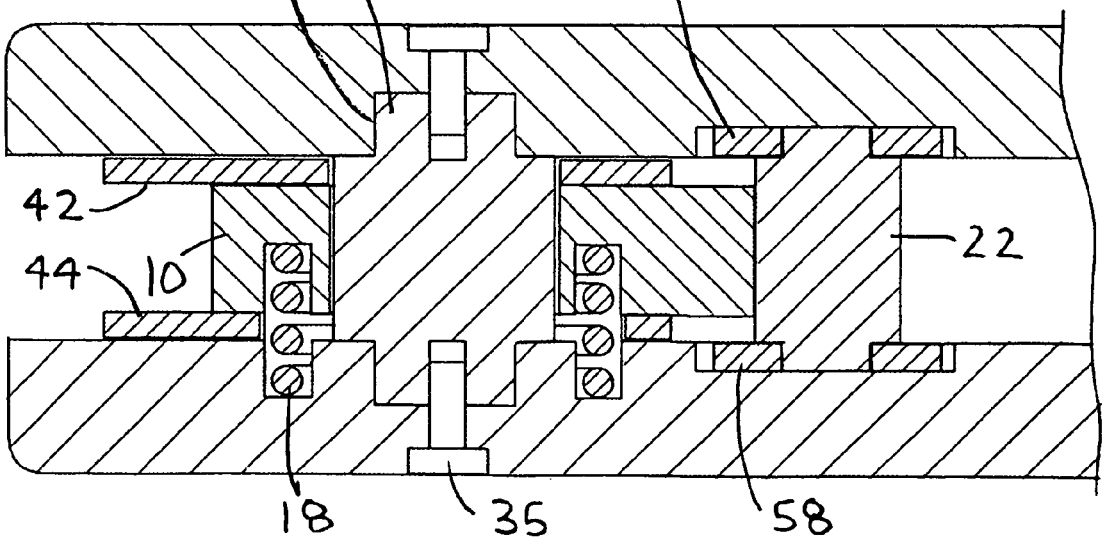

FOLDING KNIFE WITH OPENING AND CLOSING ASSISTANCE

CROSS-REFERENCES TO RELATED APPLICATIONS

This is a utility patent application taking priority from provisional application No. 60/673,700 filed on Apr. 21, 2005.

BACKGROUND OF THE INVENTION

1. Field of the Invention

The present invention relates generally to folding knifes and more specifically to a folding knife with opening and closing assistance.

2. Discussion of the Prior Art

One example of a knife having opening and closing assistance is U.S. Pat. No. 6,397,476 to Onion. The Onion patent includes a mechanism in a folding knife that urges the blade to move to an open and alternatively to a closed position.

Accordingly, there is a clearly felt need in the art for a folding knife with opening and closing assistance, which includes a coil spring for assisting opening the folding knife.

SUMMARY OF THE INVENTION

The present invention provides a folding knife with opening and closing assistance, which includes a coil spring. The folding knife with opening and closing assistance (folding knife) preferably includes a blade, a blade spacer, a first frame, a second frame, a coil spring, an open lock pin and a closed lock pin. A pivot post is inserted through one end of the blade. The pivot post is retained between the first and second frames at the first ends thereof. A cutting edge is formed on at least one side of the blade. The blade spacer is retained between the first and second frames. The coil spring is received by the pivot post and biases the blade to be in an open position.

The open lock pin is preferably retained in the first frame and axially loaded with a compression spring. An open lock notch is formed in the one end of blade such that the blade may be locked in an open position with the open lock pin. The closed lock pin is preferably radially spring loaded between the first and second frames with a pair of torsion springs. A closed lock notch is formed in the first end of the blade to receive the closed lock pin. The blade is retained in a closed position, when the closed lock pin is retained in the closed lock notch. A safety notch is preferably formed adjacent the closed lock notch. Other methods of retaining the blade in a closed position may also be used.

Accordingly, it is an object of the present invention to provide a folding knife, which includes a coil spring for assisting opening the folding knife.

These and additional objects, advantages, features and benefits of the present invention will become apparent from the following specification.

BRIEF DESCRIPTION OF THE DRAWINGS

FIG. 6 is a cross sectional view of a folding knife displaying a section cut through FIG. 4 in accordance with the present invention.

FIG. 7 is a perspective of an open lock pin of a folding knife in accordance with the present invention.

FIG. 8 is a cross sectional view of a folding knife displaying a second cut through FIG. 4 in accordance with the present invention.

DETAILED DESCRIPTION OF THE PREFERRED EMBODIMENTS

Figure 1:
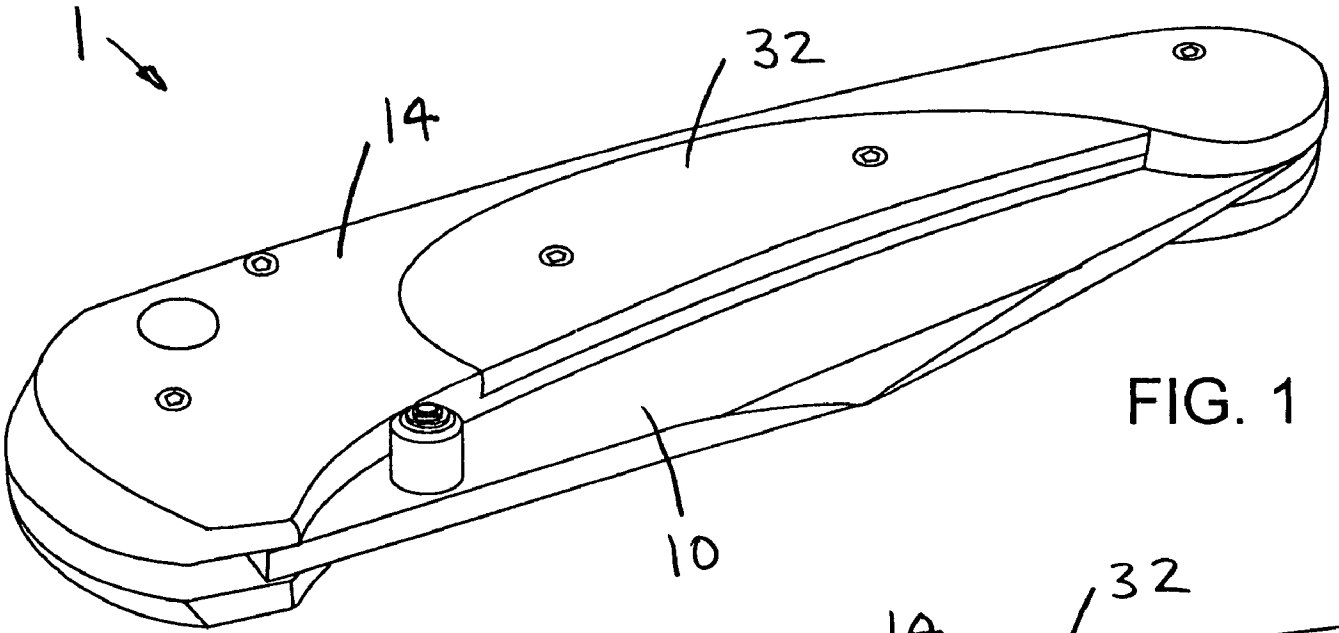
FIG. 1 is a perspective view of a folding knife with a blade in a closed position in accordance with the present invention.
Figure 2:
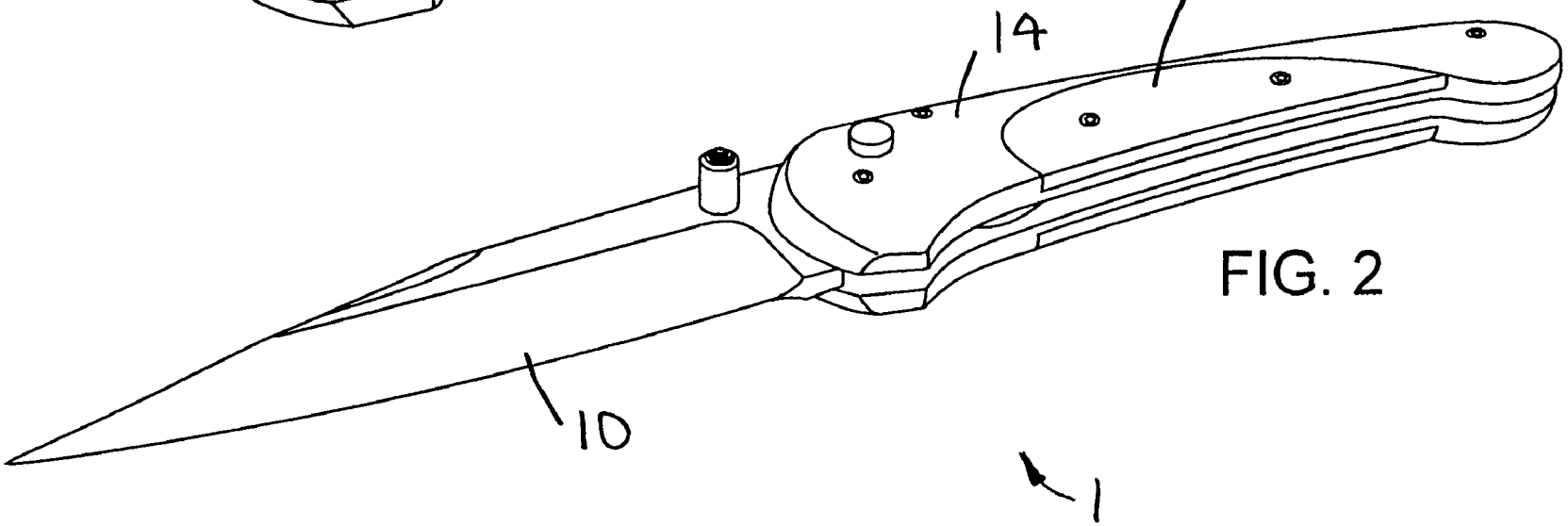
FIG. 2 is a perspective view of a folding knife with a blade in an open position in accordance with the present invention.
Figure 3:
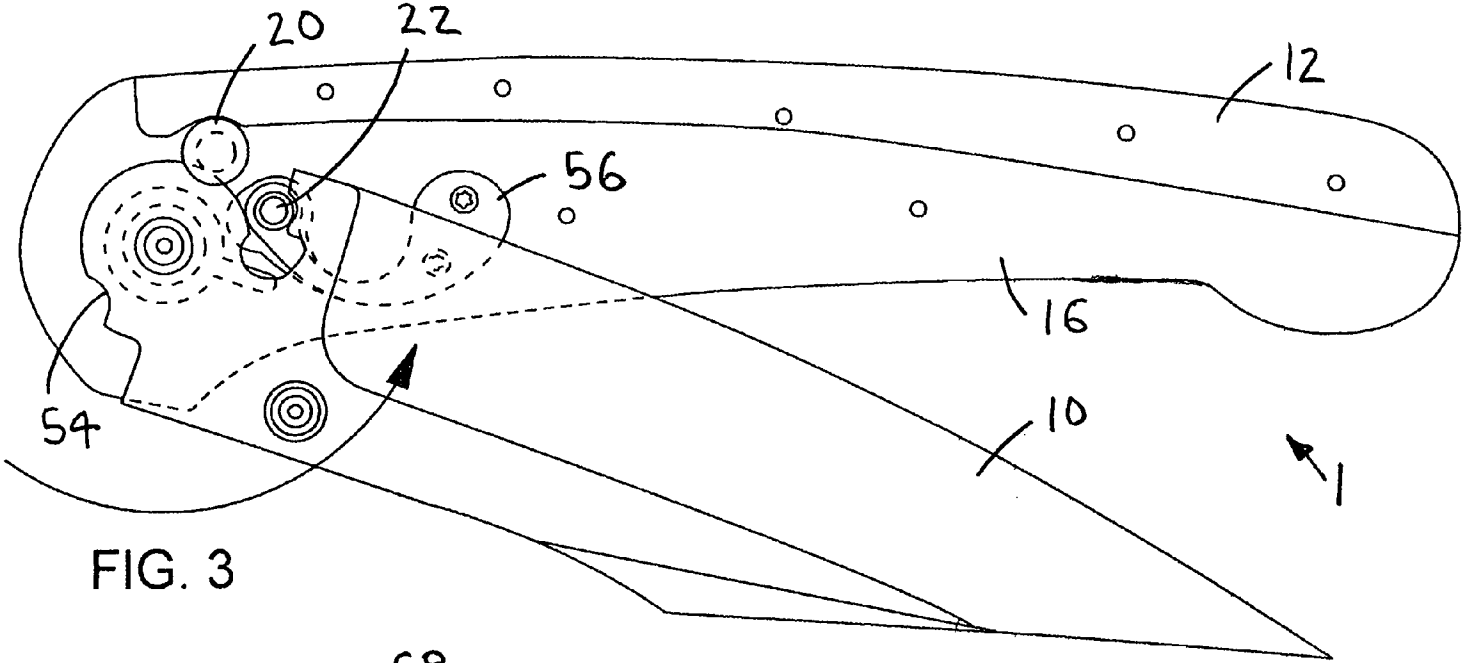
FIG. 3 is a front view of a folding knife with a blade in a partially closed position with a first frame removed in accordance with the present invention.
Figure 4:
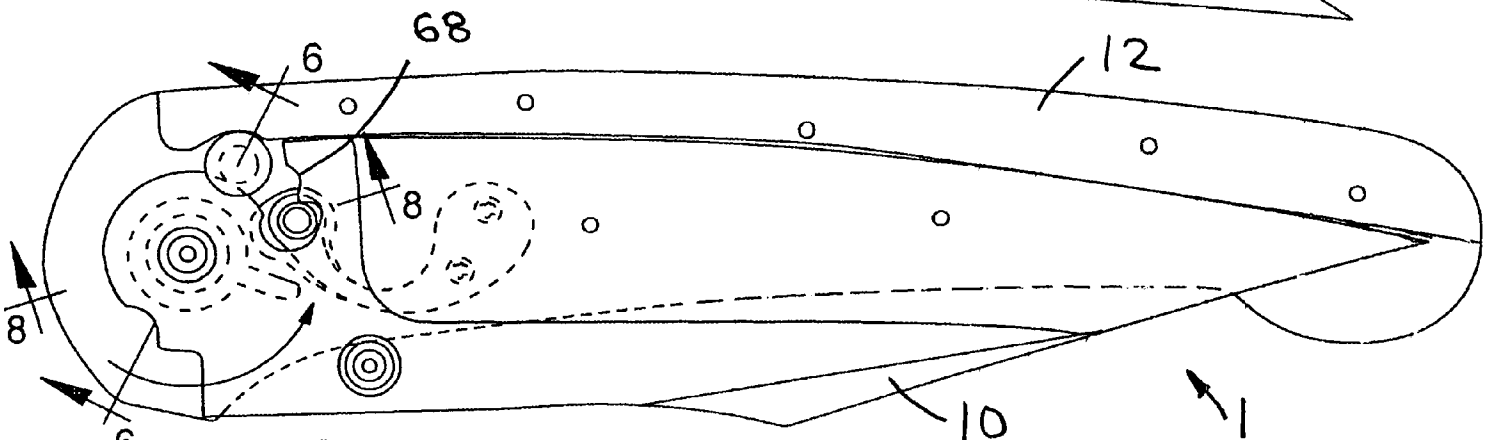
FIG. 4 is a front view of a folding knife with a blade in a closed position with a first frame removed in accordance with the present invention.
Figure 5:
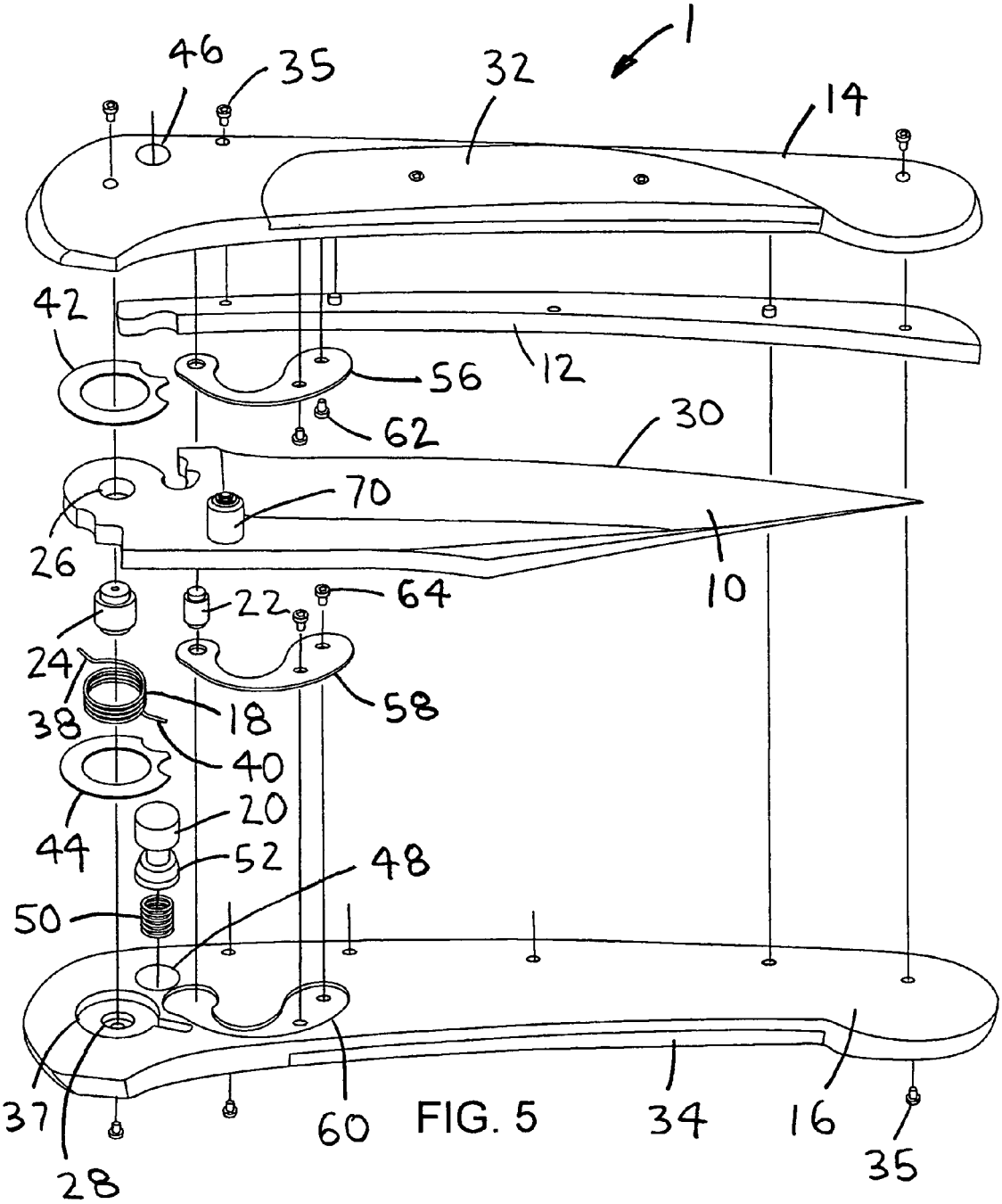
FIG. 5 is an exploded perspective of a folding knife with a blade in a closed position in accordance with the present invention.
Figure 9:
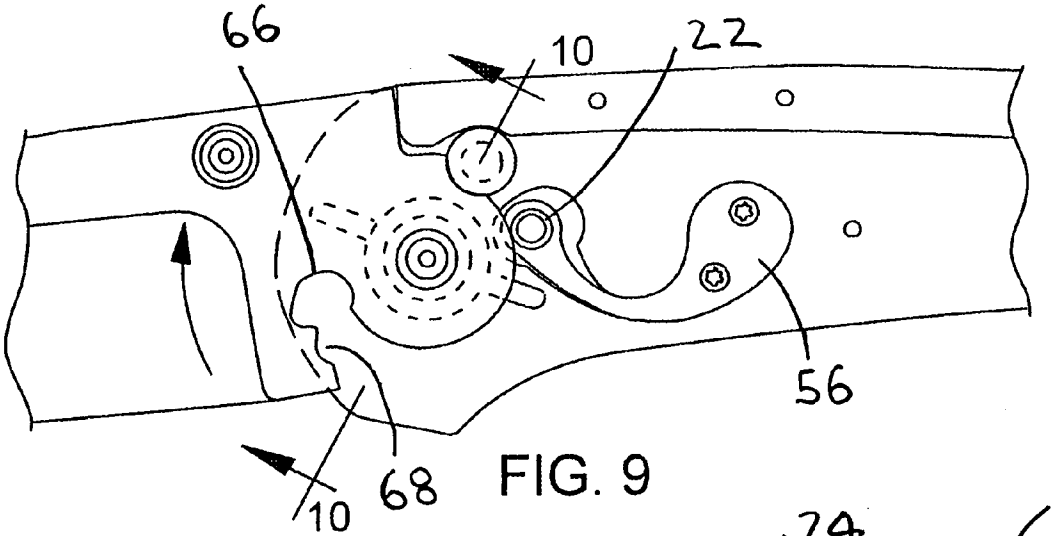
FIG. 9 is a partial side view of a folding knife in accordance with the present invention.
Figure 10:
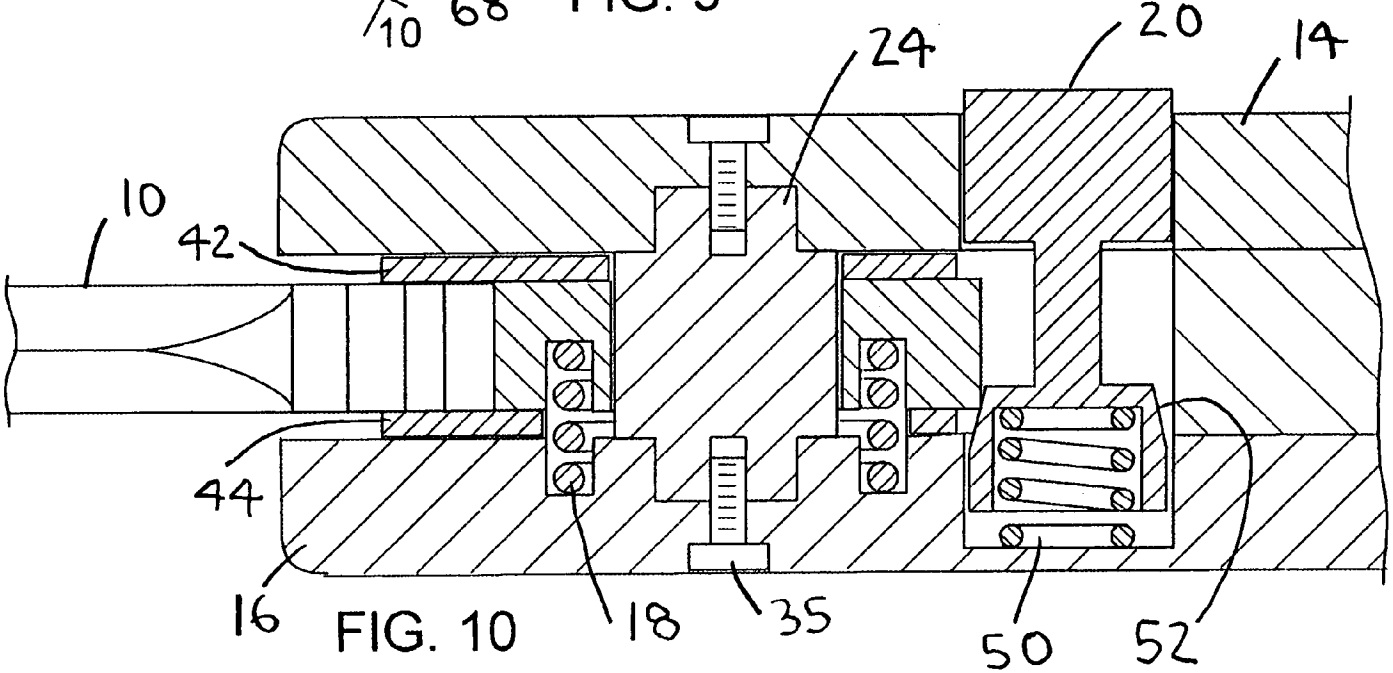
FIG. 10 is a cross sectional view of a folding knife displaying a section cut through FIG. 9 in accordance with the present invention.

With reference now to the drawings, and particularly to FIG. 2, there is shown a perspective view of a folding knife 1. With reference to FIGS. 1, 3-5, the folding knife 1 preferably includes a blade 10, a blade spacer 12, a first frame 14, a second frame 16, a coil spring 18, an open lock pin 20 and a closed lock pin 22. A pivot post 24 is inserted through a post hole 26 in one end of the blade 10. With reference to FIG. 6, the pivot post 24 is retained in a first pivot hole 26 in the first frame 14 and in a second pivot hole 28 in the second frame 16. A cutting edge 30 is formed on at least one side of the blade 10. The blade spacer 12 is retained between the first and second frames. A first insert 32 is preferably attached to an outside surface of the first frame 14 and a second insert 34 is preferably attached to an outside surface of the second frame 16. A plurality of fasteners 35 are used to assembly the folding knife 1.

A first spring pocket 36 is formed in the one end of the blade 10 to receive an outside perimeter of the coil spring 18. A second spring pocket 37 is formed in the second frame 16 to receive an outside perimeter of the coil spring 18. The coil spring 18 includes a first leg 38 and a second leg 40. The first spring pocket 36 is sized to retain the first leg 38 and the second spring pocket 37 is sized to retain the second leg 40. A first spacer washer 42 is inserted between one side of the blade 10 and the first frame 14 and a second spacer washer 44 is inserted between one side of the blade 10 and the second frame 16. The coil spring 18 biases the blade 10 to be in an open position.

The open lock pin 20 is preferably retained in a lock pin opening 46 contained in the first frame 14. A lock spring pocket 48 is formed in the second frame 16 to receive a compression spring 50. A tapered surface 52 is formed on a bottom portion of the open lock pin 20. An open lock notch 54 is formed in the one end of blade 10 such that the blade 10 may be locked in an open position with the open lock pin 20. Depressing the open lock pin 20 releases the tapered surface 52 from engagement with the open lock notch 54 to allow the blade 10 to be placed in a closed or partially closed position. The lock pin 20 is only one of many methods that could be used to release the blade 10 from an open position.

The closed lock pin 22 is preferably spring loaded with a a first torsion spring 56 and a second torsion spring 58 or any other suitable method. The closed lock pin 22 is retained between the first and second torsion springs. The closed lock pin 22 may be inserted into an outer tube (not shown) to decrease rolling friction. A first spring slot (not shown) is preferably formed in the first frame 14 to receive the first torsion spring 56 and a second spring slot 60 is preferably formed in the second frame 16 to receive the second torsion spring 58. One end of the first torsion spring 56 is attached to the first frame 14 with fasteners 62. One end of the second torsion spring 58 is attached to the second frame 16 with fasteners 64. The first and second spring slots provide sufficient clearance to allow the other ends of the first and second torsion springs to have radial movement within the first and second spring slots, respectively. However, other methods of retaining the blade 10 in closed or partially closed positions may also be used. The first and second torsion springs also provide assistance for closing the folding knife.

A closed lock notch 66 is formed in the first end of the blade 10 to receive the closed lock pin 22. The blade 10 is retained in a closed position, when the closed lock pin 22 is retained in the closed lock notch 66. The closed lock pin 22 is retained in the closed lock notch 66 by the force exerted by the first and second torsion springs. A safety notch 68 is preferably formed in the first end of the blade 10, adjacent the closed lock notch 66. The spring pressure of the closed lock pin 22 against the safety notch 68, prevents the blade 10 from opening at a high rate of speed, once the closed lock pin 22 clears the closed lock notch 66. The closed lock pin 22 is retained against the safety notch 68 by the force exerted by the first and second torsion springs. A thumb stud 70 is attached to the blade 10 adjacent the closed lock notch 66. The thumb stud 70 allows the blade 10 to be opened with a thumb.

Figure 11:
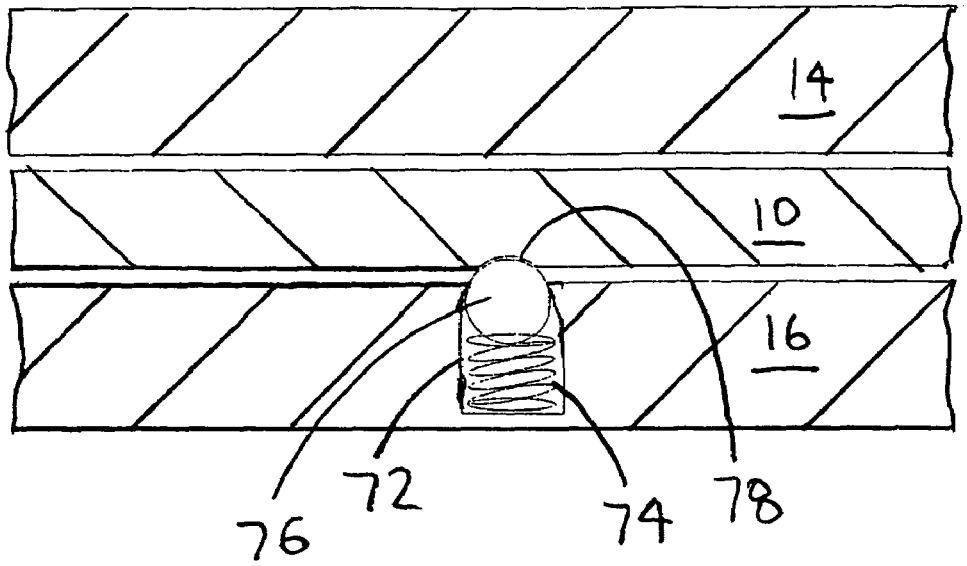
FIG. 11 is a cross sectional view of a first alternative method of retaining a blade of a folding knife in closed or partially closed positions in accordance with the present invention.

FIG. 11 shows a first alternative method of retaining the blade 10 in a closed or partially closed position. A spring hole 72 is formed in either the second frame 16 or the first frame 14. A compression spring 74 and a spring ball 76 are inserted into the spring hole 72. A top of the spring hole 72 is peened over to retain the spring ball 76. A ball cavity 78 is formed in the blade 10, concentric with the spring hole 72. The spring ball 76 is retained in the ball cavity 78, which prevents the blade 10 from pivoting relative to the first and second frames.

Figure 12:
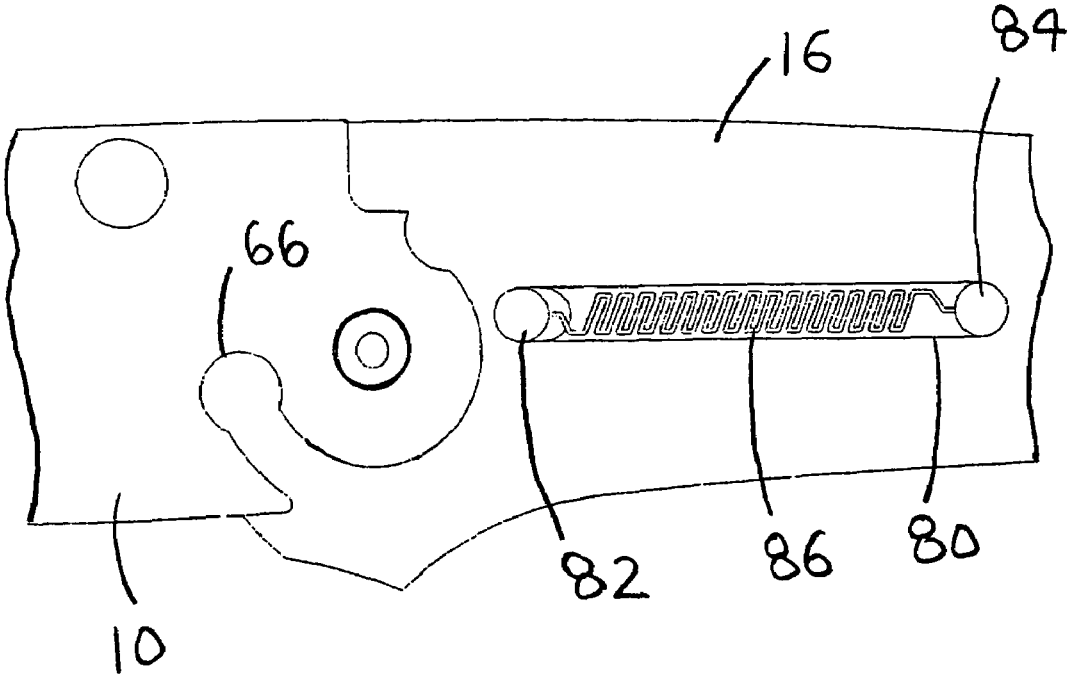
FIG. 12 is a side view of a second alternative method of retaining a blade of a folding knife in closed or partially closed positions with the first frame removed in accordance with the present invention.

FIG. 12 shows a second alternative method of retaining the blade 10 in a closed or partially closed position. A spring slot 80 is formed in the second frame 16. A sliding pin 82 is slidably retained in one end of the spring slot 80. An anchor pin 84 is rigidly retained in the other end of the spring slot 80. One end of an extension spring 86 is attached to the sliding pin 82 and the other end is attached to the anchor pin 84. The sliding pin 82 is sized to be received by the closed lock notch 66. The extension spring pulls the sliding pin 82 toward the anchor pin 84 to lock the blade 10 in a closed position.

Figure 13:
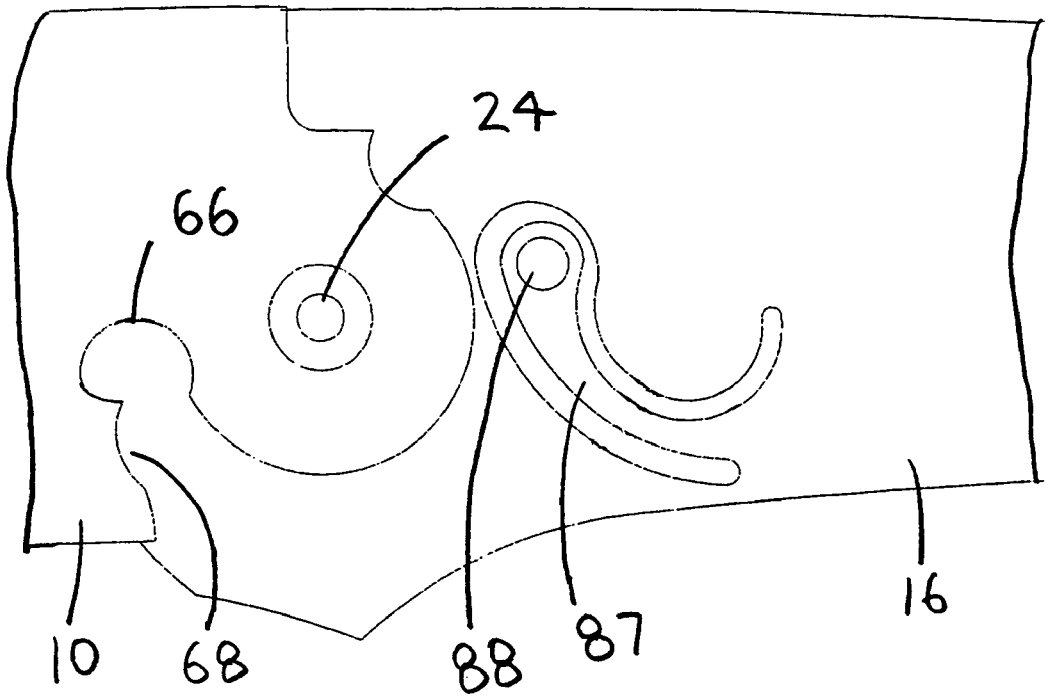
FIG. 13 is a side view of a third alternative method of retaining a blade of a folding knife in closed or partially closed positions with a first frame removed in accordance with the present invention.

FIG. 13 shows a third alternative method of retaining the blade 10 in a closed or partially closed position. A torsion spring 87 is formed in the second frame 16 by removing material around the torsion spring 87. A lock pin 88 is attached to an end of the torsion spring 87. The lock pin 88 is sized to be received by the closed lock notch 66. The torsion spring 87 pulls the lock pin 88 away from the pivot post 24 to lock the blade 10 in a closed position. A second torsion spring may also be formed in the first frame 14 and the other end of the lock pin 88 attached to one end of the second torsion spring. The first and second liners must be fabricated from a material having memory.

Figure 14:
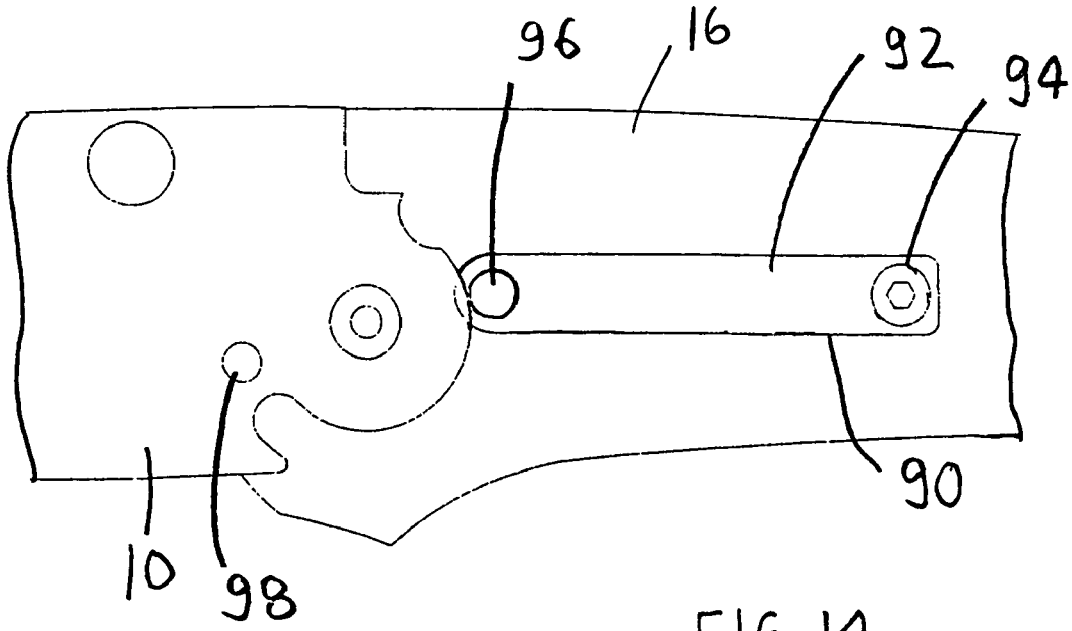
FIG. 14 is a side view of a fourth alternative method of retaining a blade of a folding knife in closed or partially closed positions with a first frame removed in accordance with the present invention.

FIG. 14 shows a fourth alternative method of retaining the blade 10 in a closed or partially closed position. A spring pocket 90 is formed in the second frame 16. One end of a leaf spring 92 is retained in the spring pocket 90 with a fastener 94 or the like. The other end of the leaf spring 92 is biased out-of the spring pocket 90. A lock pin 96 is attached to the other end of the leaf spring 92. A half-spherical shape is formed on a top of the lock pin 96. A detent hole 98 is formed through the blade 10 to receive the top of the lock pin 96. The lock pin 96 locks the blade 10 in a closed position.

Figure 15:
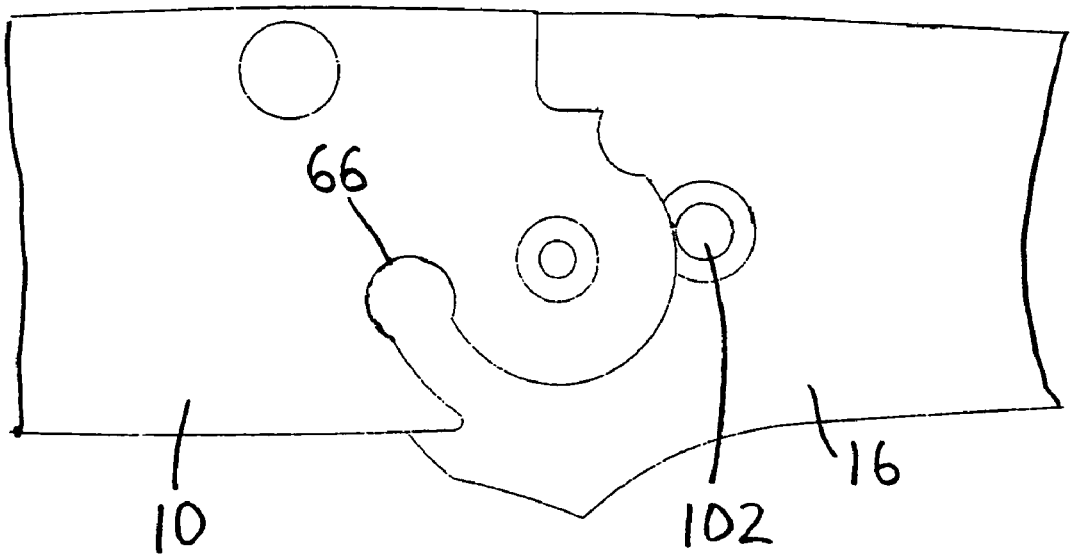
FIG. 15 is a side view of a fifth alternative method of retaining a blade of a folding knife in closed or partially closed positions with the first frame removed in accordance with the present invention.

FIG. 15 shows a fifth alternative method of retaining the blade 10 in a closed or partially closed position. A closed spring loaded projection 102 is formed in the second frame 16. The closed lock notch 66 is sized to receive the closed spring loaded projection 102. The projection 102 retains the blade 10 in a closed position. A top of the projection 102 could have a tapered shape or a spherical shape. The blade 10 is pivoted to push the projection 102 to out of the closed lock notch 66.

Figure 16:
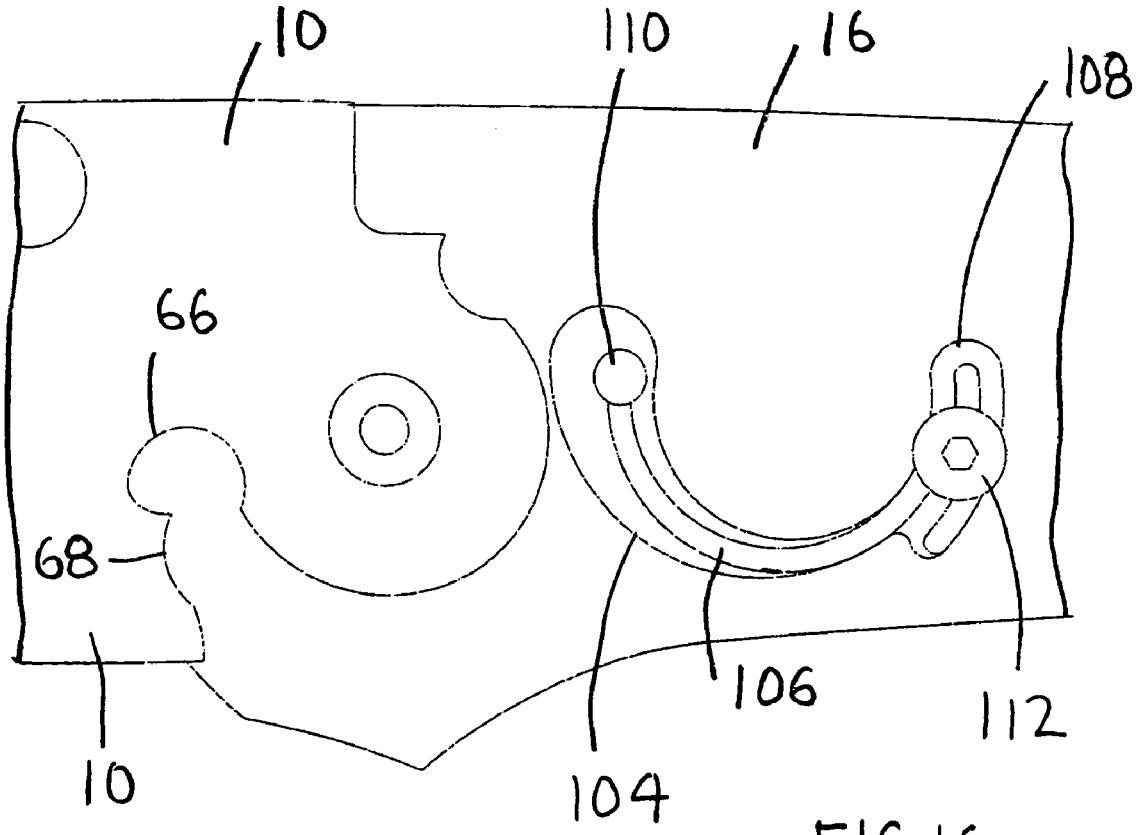
FIG. 16 is a side view of a sixth alternative method of retaining a blade of a folding knife in closed or partially closed positions with the frame removed in accordance with the present invention.

FIG. 16 shows a sixth alternative method of retaining the blade 10 in a closed or partially closed position. A spring pocket 104 is formed in the second frame 16. The spring pocket 104 is shaped to receive a torsion spring 106. An U-shaped end 108 is formed on one end of the torsion spring 106 and a retaining pin 110 is attached on the other end thereof. The torsion spring 106 is fabricated from a piece of wire having memory. A fastener 112 is inserted into the U-shaped end 108 to retain the torsion spring 106 in the spring pocket 104. The retaining pin 110 is sized to be received by the closed lock notch 66 and the safety notch 68. The blade 10 is locked in a closed position, when the retaining pin 110 is disposed in the closed lock notch 66. The blade 10 is locked in a partially closed position, when the retaining pin 110 is disposed in the safety notch 68.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of providing a folding knife, comprising the steps of:

connecting pivotally a blade to at least one of a first frame and a second frame;

providing at least one substantially U-shaped torsion spring, securing one end of said at least one substantially U-shaped torsion spring to at least one of said first and second frames, extending a pin from the other end of said at least one substantially U-shaped torsion spring;

forming a first notch in a first end of said blade, said first notch engaging said pin and retaining said blade in a closed position; and forming a second notch adjacent said first notch, said second notch engaging said pin and retaining said blade in a substantially closed position.

2. The method of providing a folding knife of claim 1, further comprising the step of:

biasing said blade to open with a coil spring.

3. The method of providing a folding knife of claim 1, further comprising the step of:

retaining a spring loaded open lock pin in at least one of said first and second frames, forming an open lock notch in a first end of said blade, said blade being retained in an open position when said open lock pin is disposed in said open lock notch.

4. The method of providing a folding knife of claim 1, further comprising the step of:

making said at least one substantially U-shaped torsion spring from a flat piece of material.

5. The method of providing a folding knife of claim 1, further comprising the step of:

forming said at least one substantially U-shaped torsion spring from at least one of said first and second frames.

6. The method of providing a folding knife of claim 1, further comprising the step of:

forming said at least one substantially U-shaped torsion spring from a piece of wire.

7. A method of providing a folding knife, comprising the steps of:

connecting pivotally a blade to at least one of a first frame and a second frame;

biasing said blade to open with a coil spring;

providing a first substantially U-shaped torsion spring and a second substantially U-shaped torsion spring, securing one end of said first substantially U-shaped torsion spring to said first frame, securing one end of said second substantially U-shaped torsion spring to said second frame, extending a pin from the other ends of said first and second substantially U-shaped torsion springs;

forming a first notch in a first end of said blade, said first notch engaging said pin and retaining said blade in a closed position; and forming a second notch adjacent said first notch, said second notch engaging said pin and retaining said blade in a substantially closed position.

8. The method of providing a folding knife of claim 7, further comprising the step of:

retaining a spring loaded open lock pin in at least one of said first and second frames, forming an open lock notch in a first end of said blade, said blade being retained in an open position when said open lock pin is disposed in said open lock notch.

9. The method of providing a folding knife of claim 7, further comprising the step of:

making said first and second substantially U-shaped torsion springs from two flat pieces of material.

10. The method of providing a folding knife of claim 7, further comprising the step of:

forming said first and second substantially U-shaped torsion springs from said first and second frames, respectively.

11. The method of providing a folding knife of claim 7, further comprising the step of:

forming said first and second substantially U-shaped torsion springs from two pieces of wire.

12. A method of providing a folding knife, comprising the steps of:

connecting pivotally a blade to at least one of a first frame and a second frame;

providing a first torsion spring and a second torsion spring, securing one end of said first torsion spring to said first frame, securing said second torsion spring to said second frame, extending a pin from the other end of said first and second torsion springs;

forming a first notch in a first end of said blade, said first notch engaging said pin and retaining said blade in a closed position; and forming a second notch adjacent said first notch, said second notch engaging said pin and retaining said blade in a substantially closed position.

13. The method of providing a folding knife of claim 12, further comprising the step of:

biasing said blade to open with a coil spring.

14. The method of providing a folding knife of claim 12, further comprising the step of:

retaining a spring loaded open lock pin in at least one of said first and second frames, forming an open lock notch in a first end of said blade, said blade being retained in an open position when said open lock pin is disposed in said open lock notch.

15. The method of providing a folding knife of claim 12, further comprising the step of:

making said first and second substantially U-shaped torsion springs from two flat pieces of material.

16. The method of providing a folding knife of claim 12, further comprising the step of:

forming said first and second substantially U-shaped torsion springs from said first and second frames respectively.

17. The method of providing a folding knife of claim 12, further comprising the step of:

forming said first and second substantially U-shaped torsion springs from two pieces of wire.

18. The method of providing a folding knife of claim 12, further comprising the step of:

forming each one of said torsion springs with a substantial U-shape.

* * * * *